US011081046B2

(12) United States Patent
Xi et al.

(10) Patent No.: US 11,081,046 B2
(45) Date of Patent: Aug. 3, 2021

(54) DRIVING CHIP AND DISPLAY DEVICE HAVING THE SAME

(71) Applicant: AU Optronics Corporation, Hsin-Chu (TW)

(72) Inventors: Peng-Bo Xi, Hsin-Chu (TW); Chen-Chi Lin, Hsin-Chu (TW); Cheng-Nan Yeh, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 16/920,777

(22) Filed: Jul. 6, 2020

(65) Prior Publication Data

US 2021/0082338 A1 Mar. 18, 2021

(30) Foreign Application Priority Data

Sep. 17, 2019 (TW) ..... 108133447

(51) Int. Cl.
*G09G 3/30* (2006.01)
*G09G 3/32* (2016.01)
*G09G 3/3258* (2016.01)

(52) U.S. Cl.
CPC ..... *G09G 3/32* (2013.01); *G09G 3/3258* (2013.01); *G09G 2300/08* (2013.01); *G09G 2310/027* (2013.01); *G09G 2310/0297* (2013.01); *G09G 2320/0242* (2013.01)

(58) Field of Classification Search
CPC ..... G09G 3/32; G09G 2300/08; G09G 2310/027; G09G 2310/0297; G09G 2320/0242; G09G 3/3258
USPC ..... 345/76
See application file for complete search history.

(56) References Cited

U.S. PATENT DOCUMENTS 10,157,578 B2 12/2018 Kikuchi et al.
2009/0002280 A1* 1/2009 Kim ..... G09G 3/3258 345/76
2017/0039935 A1 2/2017 Yang et al.
2018/0247586 A1 8/2018 Vahid Far et al.
2018/0301080 A1 10/2018 Shigeta et al.

FOREIGN PATENT DOCUMENTS

CN 110085161 A 8/2019
TW 201706978 A 2/2017
WO WO 2018185433 A1 10/2018

* cited by examiner

*Primary Examiner* — Abdul-Samad A Adediran
(74) *Attorney, Agent, or Firm* — WPAT, PC

(57) ABSTRACT

A display device including a driving chip and a pixel array is provided. The driving chip is configured to provide multiple emission control signals according to a data input. A pixel array is coupled with the driving chip. M pixel circuits of the pixel array are configured to emit light respectively in M periods, and M is a positive integer. In a corresponding period of the M periods, the driving chip determines a first time length which one of the multiple emission control signals has a first voltage level, and one of the M pixel circuits emits light, in the corresponding period, for a light emission time length corresponding to the first time length.

21 Claims, 12 Drawing Sheets

DRIVING CHIP AND DISPLAY DEVICE HAVING THE SAME

CROSS-REFERENCE TO RELATED APPLICATION

This application claims priority to Taiwan Application Number 108133447, filed on Sep. 17, 2019, which is herein incorporated by reference in its entirety.

BACKGROUND

Field of Invention

The present disclosure generally relates to a micro LED display device. More particularly, the present disclosure relates to a driving chip suitable for the micro LED display device.

Description of Related Art

Compared with liquid crystal displays, micro LED displays have the advantages of low power consumption, high color saturation, high response speed, etc. The brightness of the micro LED is determined by the magnitude of the driving current flowing through it, but the wavelength of the light generated by the micro LED also changes with the magnitude of the driving current, thereby causing the color shift phenomenon. To overcome the color shift phenomenon, pixel circuits commonly used in the industry can provide driving currents with fixed magnitude and variable pulse width to the micro LED. However, the structures of these pixel circuits are complicated and thus are not suitable for displays with high pixel density.

SUMMARY

The disclosure provides a driving chip including multiple digital-to-analog converters (DACs) and multiple control circuits. The multiple DACs are configured to provide multiple input voltages according to a data input. The multiple control circuits are configured to provide multiple emission control signals. Each of the multiple control circuits is configured to provide, according to a corresponding input voltage of the multiple input voltages, a corresponding emission control signal of the multiple emission control signals. When the multiple control circuits are coupled with a pixel array, M pixel circuits of the pixel array are configured to emit light respectively in M periods, and M is a positive integer. In a corresponding period of the M periods, one of the multiple control circuits determines a first time length which the corresponding emission control signal has a first voltage level, and a corresponding pixel circuit of the M pixel circuits emits light, in the corresponding period, for a light emission time length corresponding to the first time length.

The disclosure provides a display device including a driving chip and a pixel array. The driving chip is configured to provide multiple emission control signals according to a data input. A pixel array is coupled with the driving chip. M pixel circuits of the pixel array are configured to emit light respectively in M periods, and M is a positive integer. In a corresponding period of the M periods, the driving chip determines a first time length which one of the multiple emission control signals has a first voltage level, and one of the M pixel circuits emits light, in the corresponding period, for a light emission time length corresponding to the first time length.

It is to be understood that both the foregoing general description and the following detailed description are by examples, and are intended to provide further explanation of the disclosure as claimed.

DETAILED DESCRIPTION

Figure 1:
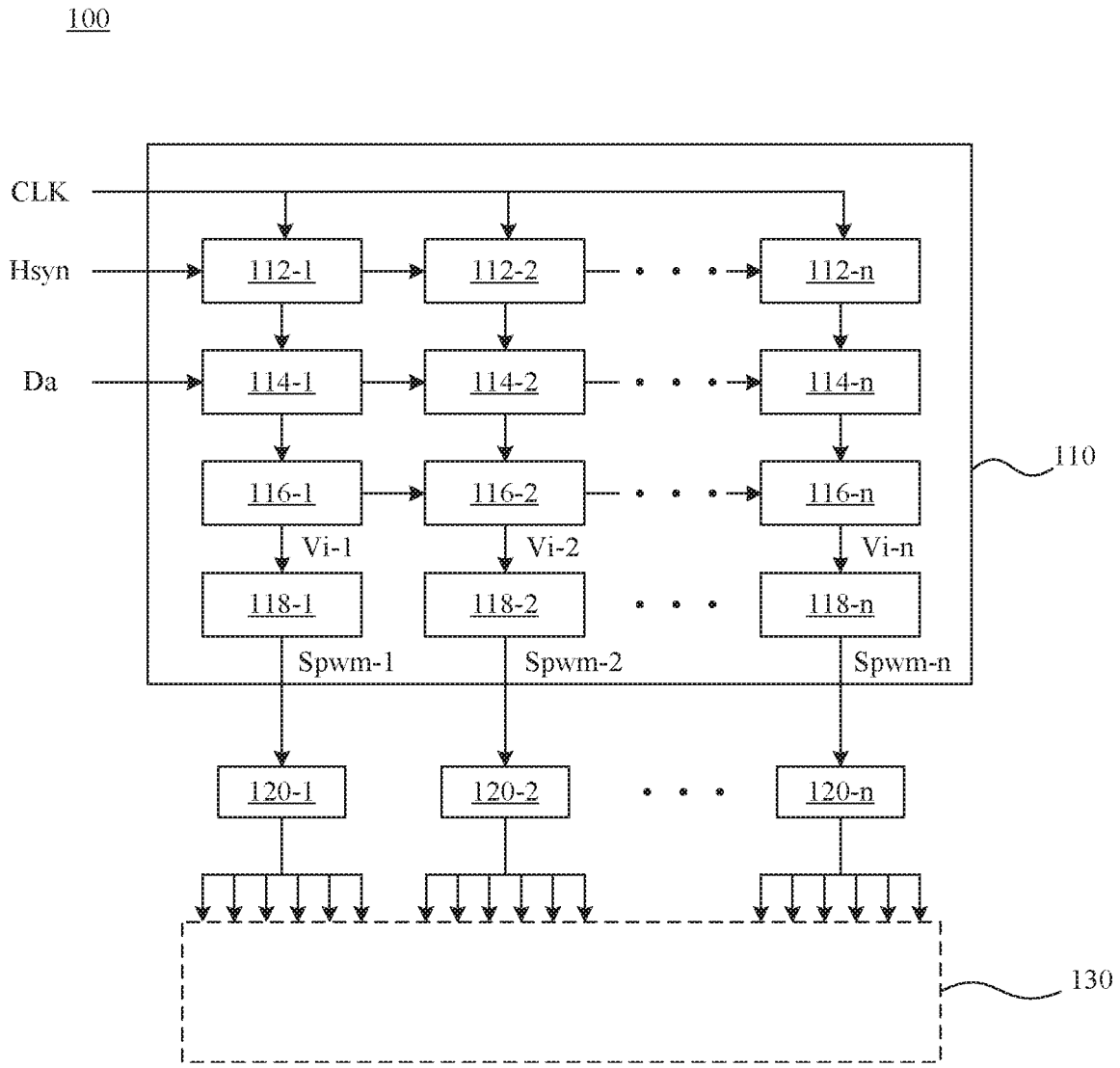
FIG. 1 is a simplified functional block diagram of a display device according to one embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

Figure 2:
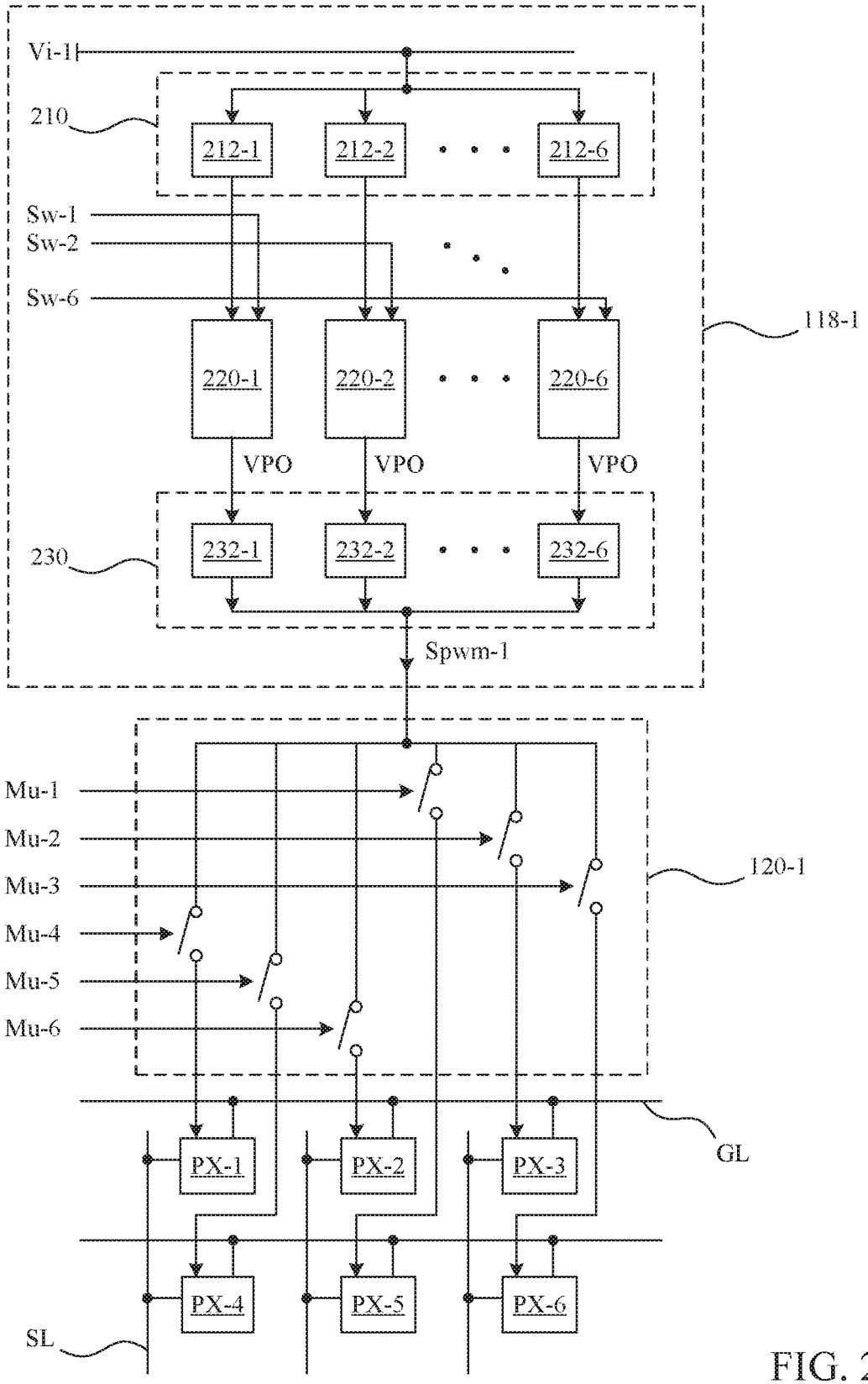
FIG. 2 is a simplified functional block diagram of the control circuit and the in-panel multiplexer of FIG. 1 according to one embodiment of the present disclosure.

FIG. 1 is a simplified functional block diagram of a display device 100 according to one embodiment of the present disclosure. FIG. 2 is a simplified functional block diagram of the control circuit 118-1 and the in-panel multiplexer 120-1 of FIG. 1 according to one embodiment of the present disclosure.

Referring to FIGS. 1 and 2, the display device 100 comprises a driving chip 110, and the driving chip 110 comprises a plurality of shift registers 112-1~**112-*n*, a plurality of data registers 114-1~114-*n*, and a plurality of digital-to-analog converters (DACs) 116-1~116-*n*. The shift registers 112-1~112-*n* are configured to sequentially enable the data registers 114-1~114-*n* according to the clock signal CLK and the horizontal sync signal Hsyn so that the data registers 114-1~114-*n*** sequentially receive the data input Da.

The data registers 114-1~**114-*n* output, in parallel, the received data input Da to the DACs 116-1~116-*n*. The DACs 116-1~116-*n* are configured to convert the received data input Da to a plurality of corresponding input voltages Vi-1**~Vi-n.

The driving chip 110 further comprises a plurality of control circuits 118-1~**118-*n*. The control circuits 118-1~118-*n* are configured to respectively receive the input voltages Vi-1~Vi-n, and to respectively output a plurality of emission control signals Spwm-1~Spwm-n. In one frame time, each of the emission control signals Spwm-1~Spwm-n may switch between a logic high level and a logic low level for multiple times. The control circuits 118-1~118-n determine, according to the input voltages Vi-1~Vi-n, the time points for each of the emission control signals Spwm-1**~Spwm-n to switch to the logic high level (or to the logic low level).

The display device 100 further comprises a plurality of in-panel multiplexers 120-1~**120-*n* and a pixel array 130. The in-panel multiplexers 120-1~120-*n* are configured to receive the emission control signals Spwm-1**~Spwm-*n*, respectively. Each of the in-panel multiplexers 120-1~**120-*n* provides a corresponding one of the emission control signals Spwm-1~Spwm-n to corresponding M pixel circuits in the pixel array 130, and M is a positive integer. For example, the in-panel multiplexer 120-1 provides the emission control signal Spwm-1 to M pixel circuits (e.g., the six pixel circuits PX-1~PX-6 of FIG. 2) coupled with the in-panel multiplexer 120-1. As another example, the in-panel multiplexer 120-2 provides the emission control signal Spwm-2 to M pixel circuits coupled with the in-panel multiplexer 120-2**, and so on.

In one frame time, the aforesaid M pixel circuits are configured to emit light in M (e.g., 6) different periods, respectively. For example, the pixel circuit PX-1 emits light in a first period, and then the pixel circuit PX-2 emits light in a second period, and so on.

When one of the M pixel circuits receives, in the light emission duration thereof, a corresponding one of the emission control signals Spwm-1~Spwm-n having a first voltage level (e.g., logic high level), the one of the M pixel circuits stops emitting light. For example, if the pixel circuit PX-1 receives, in the first period, the emission control signal Spwm-1 having the logic high level, the pixel circuit PX-1 stops emitting light. As another example, when the pixel circuit PX-2 receives, in the second period, the emission control signal Spwm-1 having the logic high level, the pixel circuit PX-2 stops emitting light, and so on.

That is, in one of the M periods, the one of the M pixel circuits emits light for a light emission time length corresponding to (e.g., negatively correlated to) a time length which the corresponding one of the emission control signals Spwm-1~Spwm-n has the first voltage level. For the purpose of illustration convenience, M is assumed to be 6 in the following embodiments, but this disclosure is not limited thereto.

Referring to FIG. 2, the control circuit 118-1 comprises a first multiplexer 210, a plurality of driving circuits 220-1~220-6, and a second multiplexer 230. The first multiplexer 210 comprises a plurality of first switching elements 212-1~212-6, and the second multiplexer 230 comprises a plurality of second switching elements 232-1~232-6.

The first switching element 212-1~212-6 are coupled with the driving circuits 220-1~220-6, respectively, and are configured to receive the input voltage Vi-1. The first switching element 212-1~212-6 provides the input voltage Vi-1 sequentially to the driving circuits 220-1~220-6. Since the input voltage Vi-1 is an alternating signal, multiple input voltages Vi-1 received by the driving circuits 220-1~220-6 may have the same or different values.

The driving circuits 220-1~220-6 are also configured to receive a plurality of scanning signals Sw-1~Sw-6, respectively. In the aforementioned M (e.g., 6) different periods, the driving circuits 220-1~220-6 correspondingly provide, according to the input voltage Vi-1 and the scanning signals Sw-1~Sw-6, the cut-off signal VPO having the first voltage level (e.g., the logic high level) so as to generate the emission control signal Spwm-1 having the first voltage level. Those related operations will be further described in the following paragraphs.

The second multiplexer 230 uses the second switching elements 232-1~232-6 to select the cut-off signal VPO provided by a corresponding one of the driving circuits 220-1~220-6 as the emission control signal Spwm-1. In this situation, the in-panel multiplexer 120-1 provides, according to the multiplexing signals Mu-1~Mu-6, the emission control signal Spwm-1 to a corresponding one of the M pixel circuits (e.g., one of the six pixel circuits PX-1~PX-6), causing the one of the pixel circuits PX-1~PX-6 stops emitting and thus the light emission duration of each of the pixel circuits PX-1~PX-6 can be determined. In this embodiment, the display device 100 comprises a plurality of reference voltage lines SL and a plurality of gate lines GL. The pixel circuits are disposed at locations corresponding to intersections of the reference voltage lines SL and the gate lines GL. The reference voltage lines SL are configured to provide a driving voltage Vpam to be described later, and the gate lines GL are configured to control corresponding switches in the pixel circuits.

For example, in the first period of a frame time, the driving circuit 220-1 provides the cut-off signal VPO according to the input voltage Vi-1 and the scanning signal Sw-1. The second multiplexer 230 selects the cut-off signal VPO provided by the driving circuit 220-1 as the emission control signal Spwm-1 having the first voltage level. The in-panel multiplexer 120-1 provides the emission control signal Spwm-1 to the pixel circuit PX-1 so that the pixel circuit PX-1 is switched from a light emitting status to a non-emitting status.

As another example, in the second period of the frame time, the driving circuit 220-2 provides the cut-off signal VPO according to the input voltage Vi-1 and the scanning signal Sw-2. The second multiplexer 230 selects the cut-off signal VPO provided by the driving circuit 220-2 as the emission control signal Spwm-1 having the first voltage level. The in-panel multiplexer 120-1 provides the emission control signal Spwm-1 to the pixel circuit PX-2 so that the pixel circuit PX-2 is switched from the light emitting status to the non-emitting status, and so on.

The foregoing descriptions regarding to the implementations, connections, operations, and related advantages of the control circuit 118-1 and the in-panel multiplexer 120-1 are also respectively applicable to other control circuits and other in-panel multiplexers of the display device 100. For the sake of brevity, those descriptions will not be repeated here.

Notably, the number of components in the control circuit 118-1 and the number of switches in the in-panel multiplexer 120-1 is merely an exemplary embodiment, and this disclosure is not limited thereto. For example, in a situation of mutually corresponding, the switches in the in-panel multiplexer 120-1, the first switching elements 212-1~212-6, the driving circuits 220-1~220-6, and the second switching elements 232-1~232-6 may each have the same number of more or less than 6 according to practical design requirement.

Figure 3:
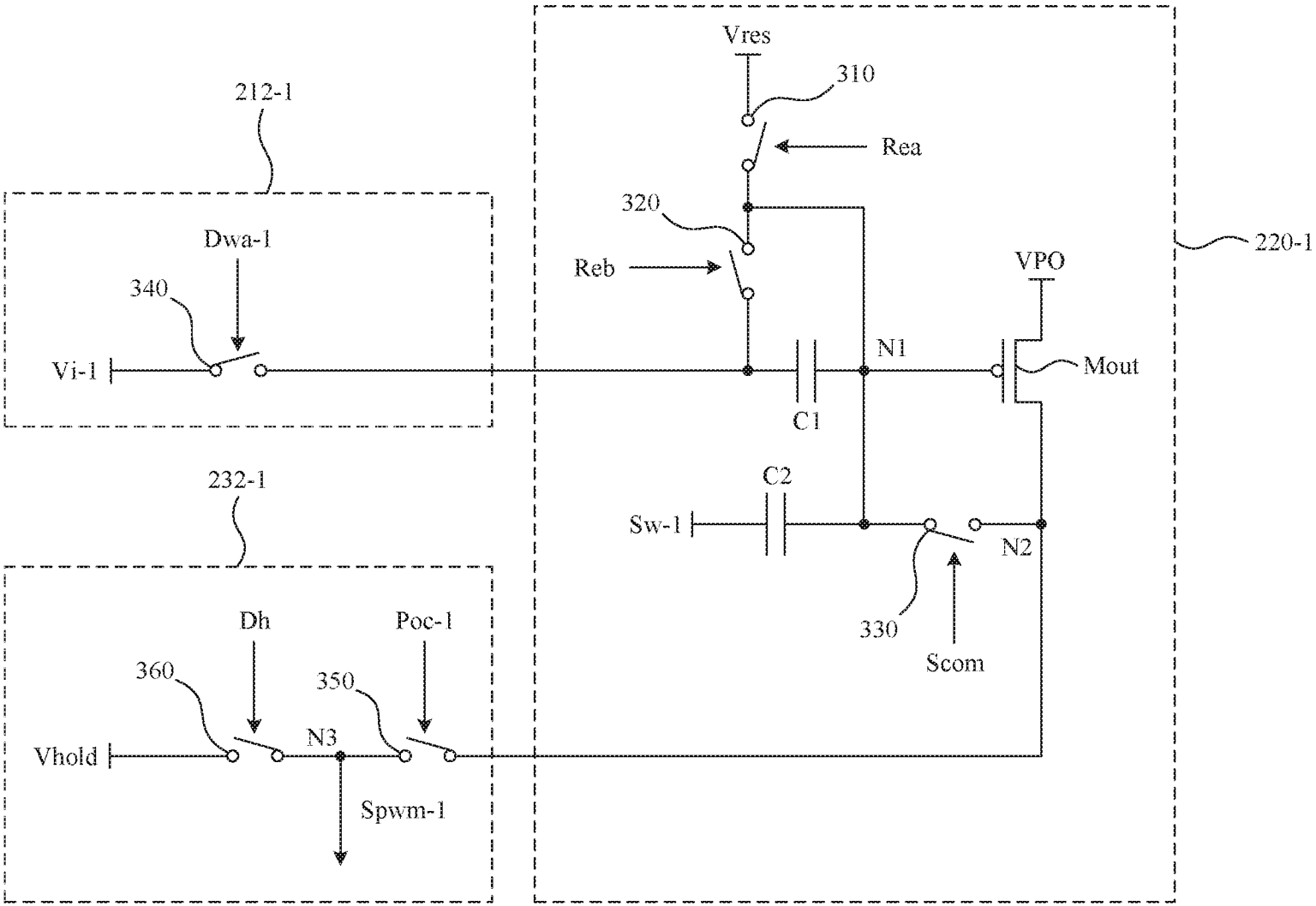
FIG. 3 is a schematic diagram for illustrating the first switching element, the driving circuit, and the second switching element according to one embodiment of the present disclosure.
Figure 4:
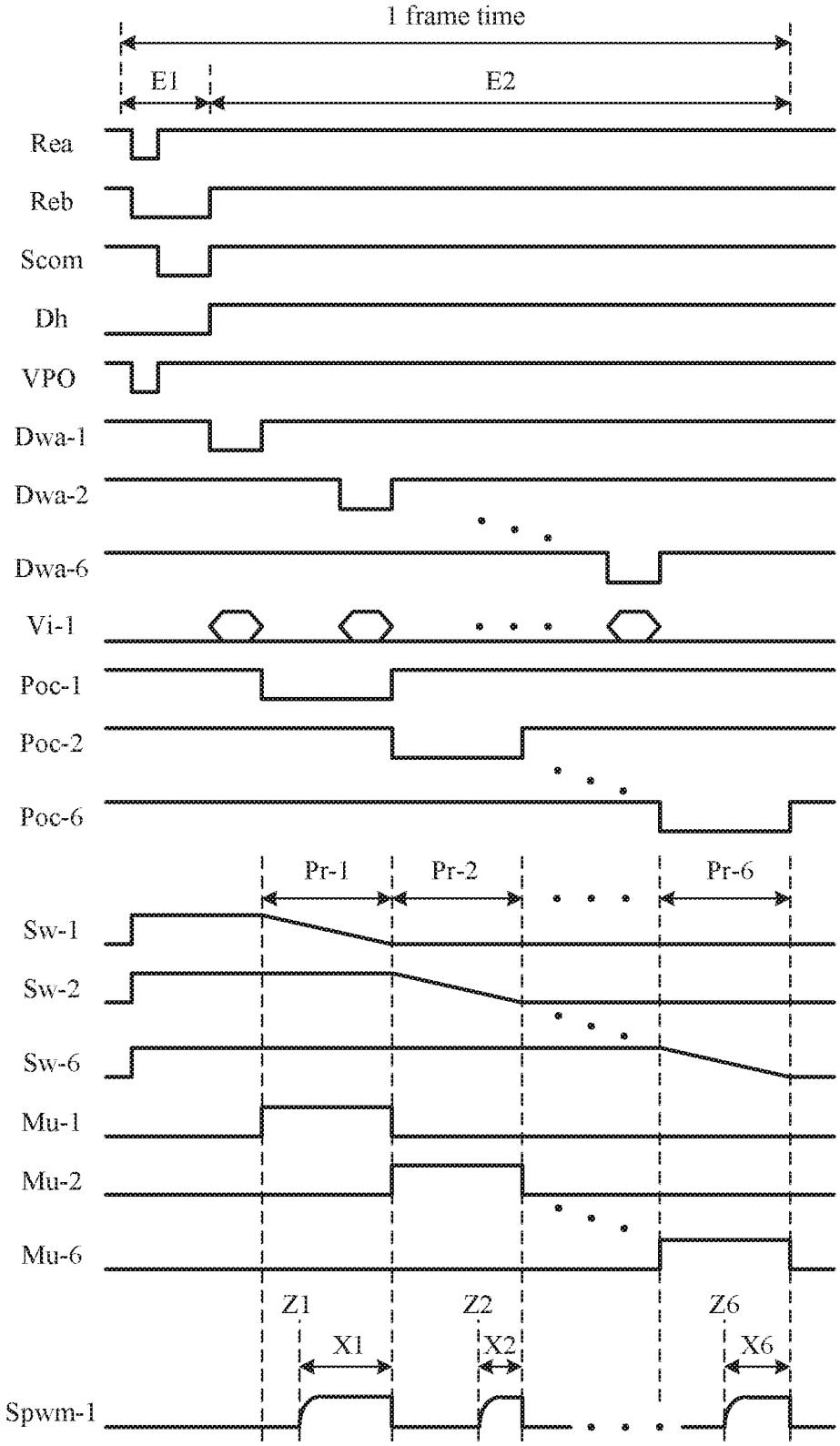
FIG. 4 is a simplified waveform schematic for illustrating a plurality of signals inputted to the display device of FIG. 1 according to one embodiment of the present disclosure.

FIG. 3 is a schematic diagram for illustrating the first switching element 212-1, the driving circuit 220-1, and the second switching element 232-1 according to one embodiment of the present disclosure. FIG. 4 is a simplified waveform schematic for illustrating a plurality of signals inputted to the display device 100 according to one embodiment of the present disclosure. In the embodiment regarding to FIGS. 3 and 4, each of the scanning signals Sw-1~Sw-6 is configured to provide a ramp pulse.

The driving circuit 220-1 comprises an output transistor Mout, a first node N1, a second node N2, a first capacitor C1, and a second capacitor C2. A first terminal of the output transistor Mout is configured to receive the cut-off signal VPO having the first voltage level (e.g., the high logic level). A second terminal of the output transistor Mout is coupled with the second switching element 232-1. A control terminal of the output transistor Mout is coupled with the first node N1. The first node N1 is configured to receive the input voltage Vi1 from the first switching element 212-1 by capacitive coupling, and also configured to receive the scanning signal Sw-1 by capacitive coupling. A second node N2 is coupled with the second terminal of the output transistor Mout, and configured to provide the cut-off signal VPO to the second switching element 232-1. A first terminal of the first capacitor C1 is coupled with the first node N1. A second terminal of the first capacitor C1 is coupled with the first switching element 212-1. A first terminal of the second capacitor C2 is coupled with the second terminal of the first capacitor C1. A second terminal of the second capacitor C2 is configured to receive the scanning signal Sw-1.

The driving circuit 220-1 further comprises a first switch 310, a second switch 320, and a third switch 330. A first terminal of the first switch 310 is coupled with the first node N1. A second terminal of the first switch 310 is configured to receive the reset voltage Vres. A control terminal of the first switch 310 is configured to receive the first reset signal Rea. A first terminal of the second switch 320 is coupled with the first node N1. A second terminal of the second switch 320 is coupled with the second terminal of the first capacitor C1. A control terminal of the second switch 320 is configured to receive the second reset signal Reb. A first terminal of the third switch 330 is coupled with the second node N2. A second terminal of the third switch 330 is coupled with the first node N1. A control terminal of the third switch 330 is configured to receive the compensation signal Scom.

The corresponding components and connections of the driving circuit 220-1 are also applicable to other driving circuits of FIG. 2, and the difference is that the driving circuits 220-2~220-6 of FIG. 2 are configured to receive scanning signals Sw-2~Sw-6, respectively.

The first switching element 212-1 comprises a fourth switch 340. A first terminal of the fourth switch 340 is coupled with the driving circuit 220-1. A second terminal of the fourth switch 340 is configured to receive the input voltage Vi-1. A control terminal of the fourth switch 340 is configured to receive the first writing signal Dwa-1.

The corresponding components and connections of the first switching element 212-1 are also applicable to other first switching elements of FIG. 2, and the difference is that the first switching elements 212-2~212-6 of FIG. 2 are configured to receive the first writing signals Dwa-2~Dwa-6, respectively, to control the respective fourth switch 340.

The second switching element 232-1 comprises a third node N3, a fifth switch 350, and a sixth switch 360. The third node N3 is configured to provide the emission control signal Spwm-1. A first terminal of the fifth switch 350 is coupled with the second node N2. A second terminal of the fifth switch 350 is coupled with the third node N3. A control terminal of the fifth switch 350 is configured to receive the first output control signal Poc-1. A first terminal of the sixth switch 360 is coupled with the third node N3. A second terminal of the sixth switch 360 is configured to receive the hold voltage Vhold. A control terminal of the sixth switch 360 is configured to receive the second output control signal Dh.

The hold voltage Vhold has a second voltage level different from the first voltage level of the cut-off signal VPO. For example, if the cut-off signal VPO has the logic high level, the hold voltage Vhold has the logic low level. As another example, if the cut-off signal VPO has the logic low level, the hold voltage Vhold has the logic high level.

The corresponding components and connections of the second switching element 232-1 are also applicable to other second switching elements of FIG. 2, and the difference is that the second switching elements 232-2~232-6 of FIG. 2 are configured to receive the first output control signals Poc-2~Poc-6, respectively, to control the respective fifth switch 350.

As shown in FIG. 4, in the first operation stage E1, the first reset signal Rea and the second reset signal Reb have the logic high level to conduct the first switch 310 and the second switch 320 so that the first node N1 and the second terminal of the first capacitor C1 are reset to the reset voltage Vres. Then, the first reset signal Rea is switched to the logic low level to switch off the first switch 310, and the compensation signal Scom has the logic high level to conduct the third switch 330. When the third switch 330 is conducted, the cut-off signal VPO charges towards the first node N1 to detect a threshold voltage of the output transistor Mout, and the detection result is stored at the first node N1.

The first output control signals Poc-1~Poc-6 have the logic low level, while the second output control signal Dh has the logic high level. Therefore, the respective fifth switches 350 of the second switching elements 232-1~232-6 are all switched off, and the respective sixth switches 360 thereof are all conducted so that the second multiplexer 230 uses the hold voltage Vhold as the emission control signal Spwm-1. Notably, the pixel circuits PX-1~PX-6 remain un-lighted during the first operation stage E1.

Then, in the second operation stage E2, the first writing signals Dwa-1~Dwa-6 are sequentially switched to the logic high level to successively conduct the respective fourth switches 340 of the first switching elements 212-1~212-6 so that the input voltage Vi-1 is provided to the driving circuits 220-1~220-6 in sequence.

The second operation stage E2 comprises 6 different periods, labeled as periods Pr-1~Pr-6 in sequence. The pixel circuits PX-1~PX-6 of FIG. 2 are configured to emit light in the periods Pr-1~Pr-6, respectively. For example, the pixel circuit PX-1 is configured to emit light in the period Pr-1, the pixel circuit PX-2 is configured to emit light in the period Pr-2, and so forth.

In this embodiment, the first output control signals Poc-1~Poc-6 and the multiplexing signals Mu-1~Mu-6 are each switched to the logic high level in the period having the corresponding index in label. For example, the first output control signal Poc-1 and the multiplexing signal Mu-1 are switched to the logic high level in the period Pr-1. As another example, the first output control signal Poc-2 and the multiplexing signal Mu-2 are switched to the logic high level in the period Pr-2, and so on.

In addition, each of the scanning signals Sw-1~Sw-6 provides the ramp pulse in the period having the corresponding index in label. For example, the scanning signal Sw-1 provides the ramp pulse in the period Pr-1. As another example, the scanning signal Sw-2 provides the ramp pulse in the period Pr-2, and so on.

Referring to FIG. 2 through 4, in period Pr-1, the voltage variation of the ramp pulse provided by the scanning signal Sw-1 is transmitted, by capacitive coupling, to the first node N1 of the driving circuit 220-1, thereby changing (e.g., pulling down) the voltage of the first node N1.

In this situation, the fifth switch 350 of the second switching element 232-1 is conducted to provide the voltage of the second node N2 as the emission control signal Spwm-1 to the in-panel multiplexer 120-1. The in-panel multiplexer 120-1 further provides the emission control signal Spwm-1 to the pixel circuit PX-1 and without providing to other pixel circuits.

When a voltage difference between the first terminal and the control terminal of the driving transistor Mout is smaller than or equal to an absolute value of the threshold voltage of the driving transistor Mout (e.g., before the time point Z1), the driving transistor Mout is switched off and the emission control signal Spwm-1 has the second voltage level of the hold voltage Vhold. As a result, the pixel circuit PX-1 keeps emitting light.

On the other hand, when the voltage difference between the first terminal and the control terminal of the driving transistor Mout is larger than the absolute value of the threshold voltage of the driving transistor Mout (e.g., after the time point Z1), the driving transistor Mout is conducted and provides the cut-off signal VPO to the second switching element 232-1. In this situation, the pixel circuit PX-1 stops emitting light because of receiving the emission control signal Spwm-1 having the first voltage level.

In other words, in the period Pr-1, the pixel circuit PX-1 emits light before the time point Z1 and stops emitting light after the time point Z1. Therefore, in the period Pr-1, the time length for which the pixel circuit PX-1 emits light corresponds to (e.g. negatively correlated to) a time length X1 for which the emission control signal Spwm-1 has the first voltage level.

Similarly, in the period Pr-2, the pixel circuit PX-2 emits light before the time point Z2, and stops emitting light after the time point Z2. Therefore, in the period Pr-2, the time length for which the pixel circuit PX-2 emits light corresponds to (e.g. negatively correlated to) a time length X2 for which the emission control signal Spwm-1 has the first voltage level. In the period Pr-6, the pixel circuit PX-6 emits light before the time point Z6, and stops emitting light after the time point Z6. Therefore, the time length for which the pixel circuit PX-6 emits light corresponds to (negatively correlated to) a time length X6 for which the emission control signal Spwm-1 has the first voltage level, and so on.

In some embodiments, one or more of the first switch 310, the second switch 320, and the third switch 330 may be omitted to reduce the circuit area.

In practice, the output transistor Mout, the first switch 310, the second switch 320, the third switch 330, the fourth switch 340, the fifth switch 350, and the sixth switch 360 in the above embodiments may be realized by various suitable P-type transistors. The switches of the in-panel multiplexers 120-1~120-6 may be realized by various suitable N-type transistors. For example, the thin-film transistors or the field-effect transistors.

In some embodiments, one or more of the output transistor Mout, the first switch 310, the second switch 320, the third switch 330, the fourth switch 340, the fifth switch 350, and the sixth switch 360 may be realized by N-type transistors instead. One or more of the in-panel multiplexers 120-1~120-6 may be realized by P-type transistors instead. In this situation, one or more corresponding control signals of FIG. 4 may be set to have opposite waveforms.

Figure 5:
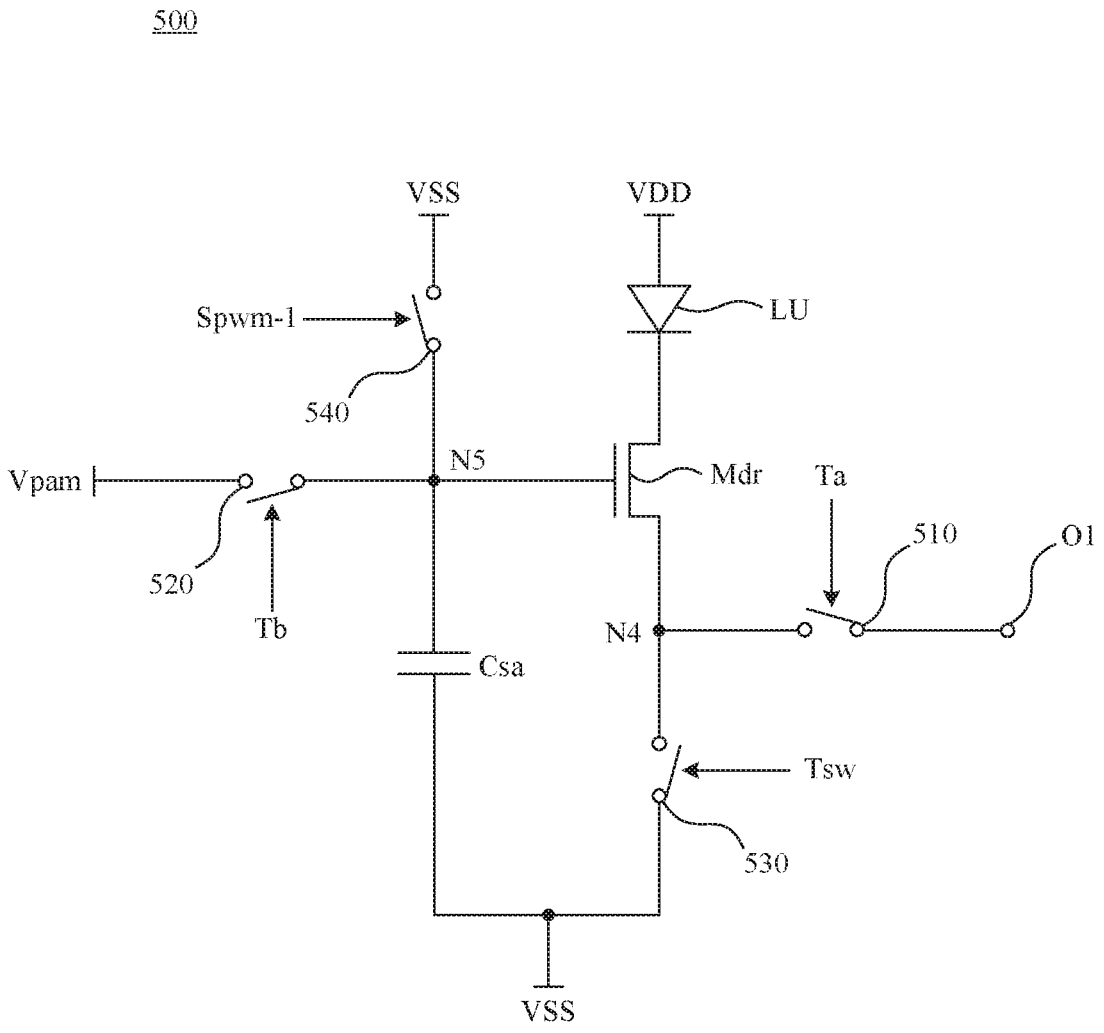
FIG. 5 is a schematic diagram of a pixel circuit according to one embodiment of the present disclosure.
Figure 6:
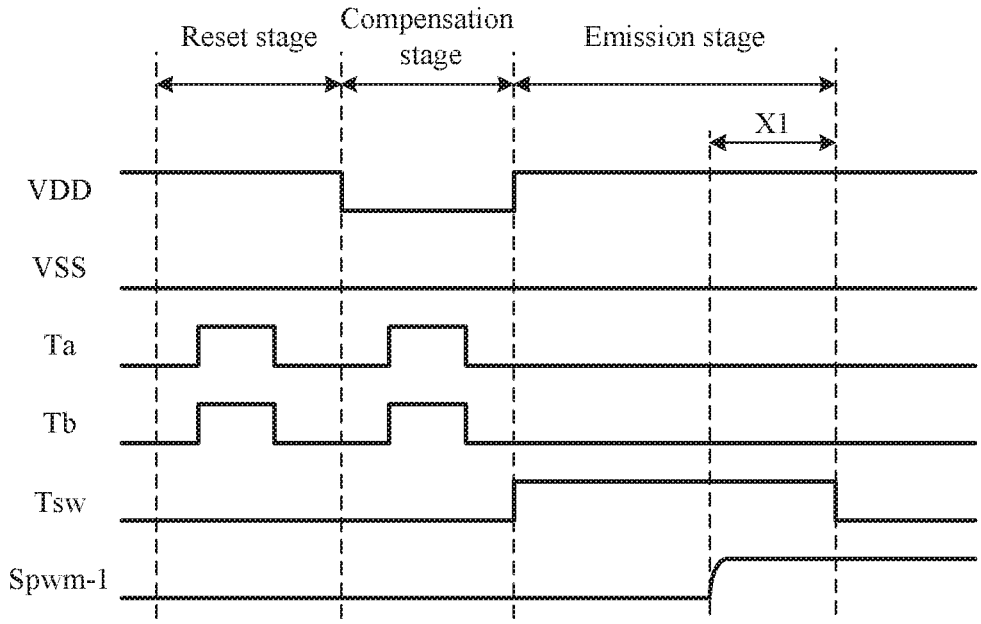
FIG. 6 is a simplified waveform schematic of a plurality of signals inputted to the pixel circuit of FIG. 5.

FIG. 5 is a schematic diagram of a pixel circuit 500 according to one embodiment of the present disclosure. FIG. 6 is a simplified waveform schematic of a plurality of signals inputted to the pixel circuit 500. The pixel circuit 500 may be used to realize the pixel circuits (e.g., the pixel circuits PX-1~PX-6) of the pixel array 130. The pixel circuit 500 comprises a pixel switch 510, a pixel switch 520, a pixel switch 530, a pixel switch 540, a driving transistor Mdr, a light emitting element LU, and a storage capacitor Csa.

A first terminal of the driving transistor Mdr is configured to receive the system high voltage VDD through the light emitting element LU, and a second terminal and a control terminal thereof are coupled with the fourth node N4 and the fifth node N5, respectively. The pixel switch 510 is coupled between the fourth node N4 and the output terminal O1, and a control terminal of the pixel switch 510 is configured to receive the first control signal Ta. A first terminal of the pixel switch 520 is coupled with the fifth node N5, and a second terminal and a control terminal thereof are configured to receive the driving voltage Vpam and the second control signal Tb, respectively.

In one embodiment, the output terminal O1 is configured to couple with an external compensation circuit (not shown in FIG. 5). The external compensation circuit is configured to detect characteristic variations of the driving transistor Mdr, and configured to adjust the driving voltage Vpam according to the detected characteristic variations.

A first terminal of the pixel switch 530 is coupled with the fourth node N4, and the second terminal and the control terminal thereof are configured to receive the system low voltage VSS and the third control signal Tsw, respectively. When a corresponding one of the aforesaid multiplexing signals Mu-1~Mu-6 is switched to the logic high level, the third control signal Tsw is also switched to the logic high level to conduct the pixel switch 530 so that the light emitting element LU emits light. For example, in one embodiment that the pixel circuit PX-1 of FIG. 3 is realized by the pixel circuit 500, when the multiplexing signal Mu-1 is switched to the logic high level in the period Pr-1, the third control signal Tsw is also switched to the logic high level.

A first terminal of the pixel switch 540 is configured to receive the system low voltage VSS, a second terminal thereof is coupled with the fifth node N5, and a control terminal thereof is configured to receive a corresponding one of the emission control signals Spwm-1~Spwm-6 (e.g., the emission control signal Spwm-1).

When the control circuit 118-1 enters the first operation stage E1 of FIG. 4, the pixel circuit 500 enters the reset stage and the input stage of FIG. 6. When the control circuit 118-1 enters the second operation stage E2 of FIG. 4, the pixel circuit 500 enters the emission stage of FIG. 6. The emission stage of FIG. 6 corresponds to one of the periods Pr-1~Pr-6 of FIG. 4.

For example, if the pixel circuit PX-1 of FIG. 2 is realized by the pixel circuit 500, when the control circuit 118-1 executes operation of the period Pr-1 of FIG. 4, the pixel circuit PX-1 enters the emission stage of FIG. 6. As another example, if the pixel circuit PX-2 is realized by the pixel circuit 500, when the control circuit 118-1 executes operation of the period Pr-2 of FIG. 4, the pixel circuit PX-2 enters the emission period of FIG. 6, and so on.

Figure 7:
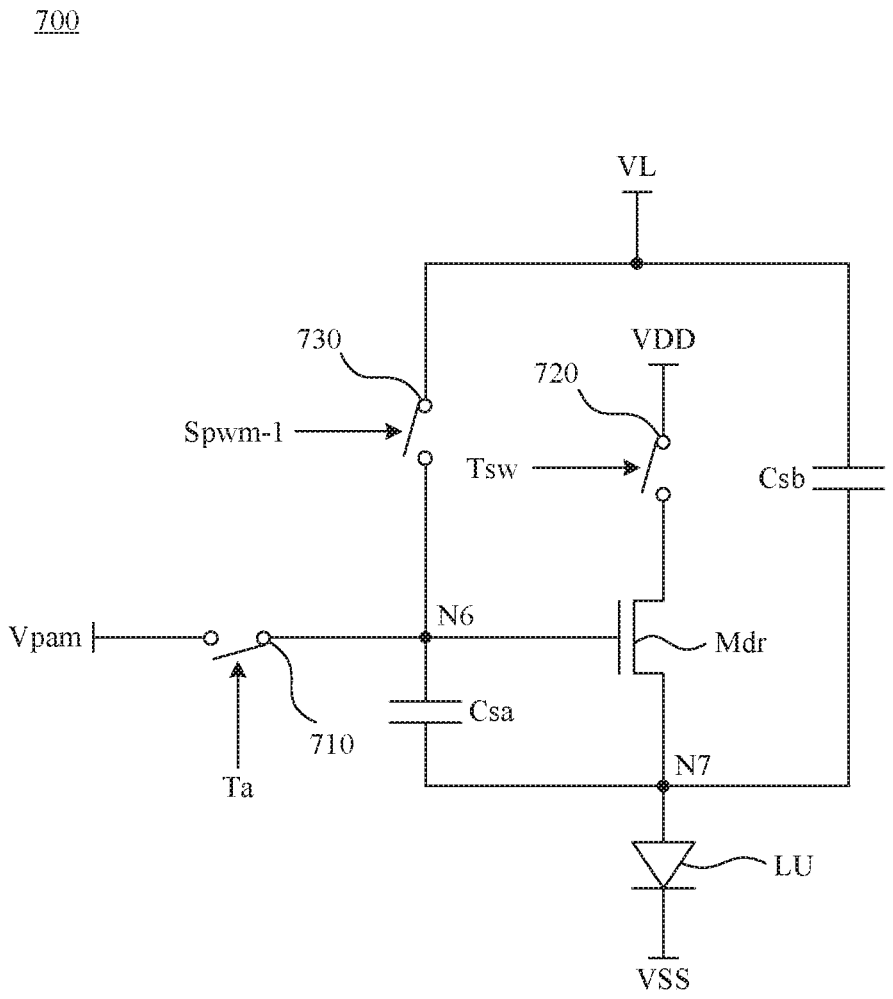
FIG. 7 is a schematic diagram of a pixel circuit according to one embodiment of the present disclosure.
Figure 8:
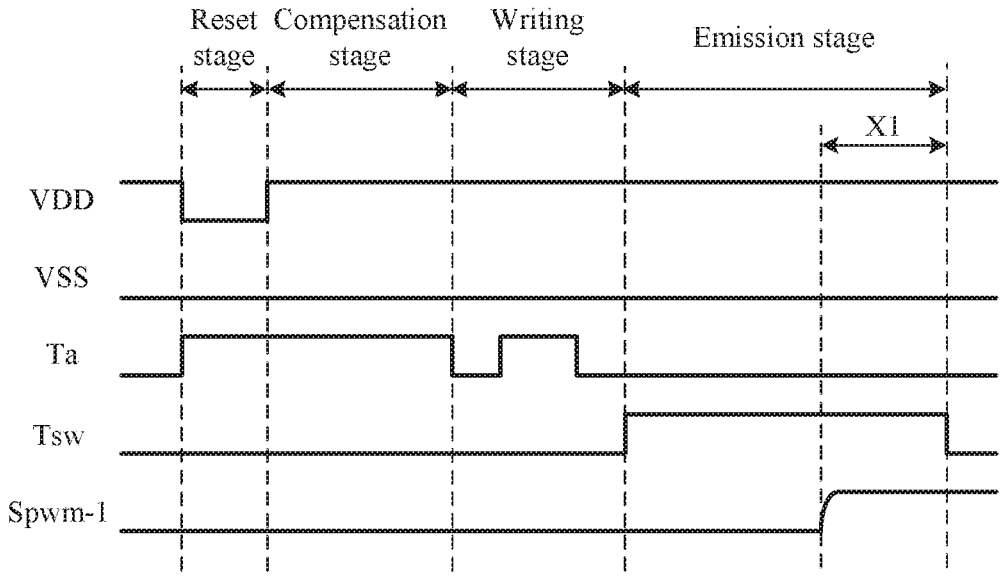
FIG. 8 is a simplified waveform schematic of a plurality of signals inputted to the pixel circuit of FIG. 7 according to one embodiment of the present disclosure.

FIG. 7 is a schematic diagram of a pixel circuit 700 according to one embodiment of the present disclosure. FIG. 8 is a simplified waveform schematic of a plurality of signals inputted to the pixel circuit 700 according to one embodiment of the present disclosure. The pixel circuit 700 comprises a pixel switch 710, a pixel switch 720, a pixel switch 730, a storage capacitor Csa, a storage capacitor Csb, and a light emitting element LU. A first terminal of the pixel switch 710 is coupled with the sixth node N6, the second terminal and the control terminal thereof are configured to receive the driving voltage Vpam and the first control signal Ta, respectively. A first terminal of the pixel switch 720 is configured to receive the system high voltage VDD, the second terminal thereof is coupled with the first terminal of the driving transistor Mdr, and the control terminal thereof is configured to receive the third control signal Tsw. The control terminal of the driving transistor Mdr is coupled with the sixth node N6, and a second terminal thereof is coupled with the seventh node N7. A first terminal of the pixel switch 730 is configured to receive the reference voltage VL, and a second terminal thereof is coupled with the sixth node N6, and a control terminal thereof is configured to receive a corresponding one of the emission control signals Spwm-1~Spwm-6 (e.g., the emission control signal Spwm-1).

A first terminal of the light emitting element LU is coupled with the seventh node N7, and a second terminal thereof is configured to receive the system low voltage VSS. A first terminal of the storage capacitor Csa is coupled with the sixth node N6, and a second terminal thereof is coupled with the seventh node N7. A first terminal of the storage capacitor Csb is configured to receive the reference voltage VL, and a second terminal thereof is coupled with the seventh node N7.

When the control circuit 118-1 enters the first operation stage E1 of FIG. 4, the pixel circuit 700 enters the reset, compensation, and input stages of FIG. 8. When the control circuit 118-1 enters the second operation stage E2 of FIG. 4, the pixel circuit 700 enters the emission stage of FIG. 8, and the emission stage of FIG. 8 corresponds to one of the periods Pr-1~Pr-6 of FIG. 4.

Figure 9:
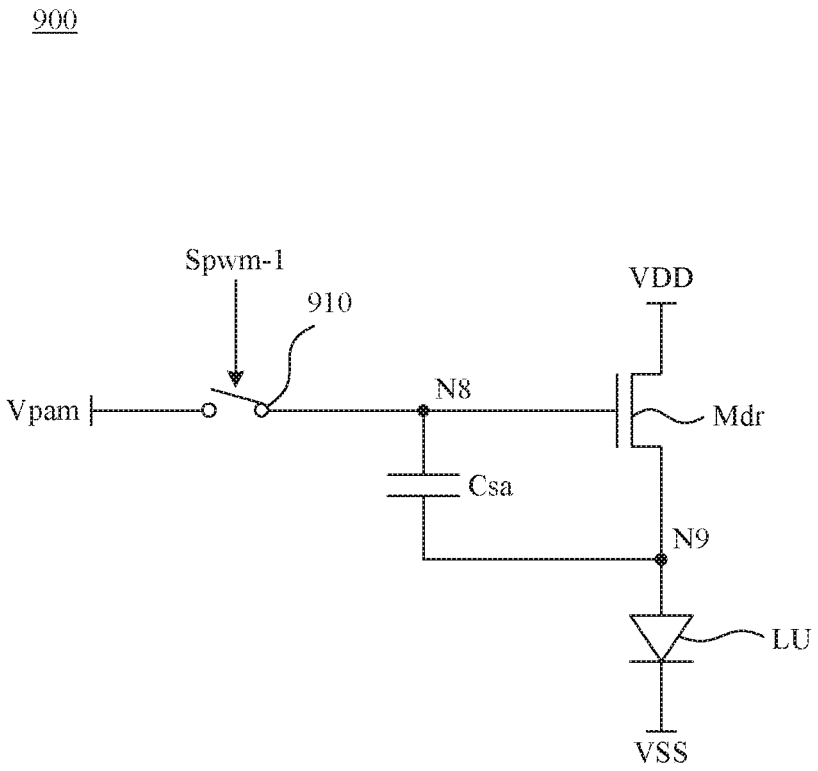
FIG. 9 is a schematic diagram of a pixel circuit according to one embodiment of the present disclosure.
Figure 10:
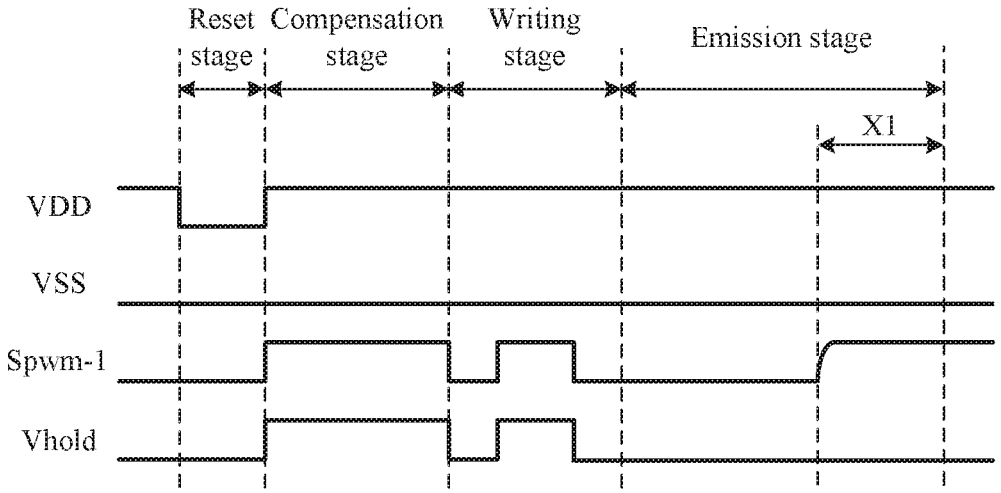
FIG. 10 is a simplified waveform schematic of a plurality of signals inputted to the pixel circuit of FIG. 9 according to one embodiment of the present disclosure.

FIG. 9 is a schematic diagram of a pixel circuit 900 according to one embodiment of the present disclosure. FIG. 10 is a simplified waveform schematic of a plurality of signals inputted to the pixel circuit 900 according to one embodiment of the present disclosure.

The pixel circuit 900 comprises a pixel switch 910, a storage capacitor Csa, a driving transistor Mdr, and a light emitting element LU. A first terminal of the pixel switch 910 is coupled with the eighth node N8, a second terminal thereof is configured to receive the driving voltage Vpam, and a control terminal thereof is configured to receive a corresponding one of the emission control signals Spwm-1~Spwm-6 (e.g., the emission control signal Spwm-1). The first terminal of the driving transistor Mdr is configured to receive the system high voltage VDD, and the second terminal and the control terminal thereof are coupled with the ninth node N9 and the eighth node N8, respectively. The storage capacitor Csa is coupled between the eighth node N8 and the ninth node N9. The first terminal of the light emitting element LU is coupled with the ninth node N9, and the second terminal thereof is coupled with the system low voltage VSS.

When the control circuit 118-1 enters the first operation stage E1 of FIG. 4, the pixel circuit 900 enters the reset, compensation, and input stages of FIG. 10. When the control circuit 118-1 enters the second operation stage E2 of FIG. 4, the pixel circuit 900 enters the emission stage of FIG. 10, and the emission stage of FIG. 10 corresponds to one of the periods Pr-1~Pr-6 of FIG. 4.

In practice, the plurality of pixel switches and the driving transistor of each of the pixel circuits 500, 700, and 900 can be realized by various suitable N-type transistors, such as TFTs or field-effect transistors. The light emitting element LU can be realized by the micro LED or the organic light-emitting diode (OLED).

In the above embodiments, the driving voltage Vpam is configured to set the driving transistor Mdr to operate in the saturation region.

In some embodiments, the driving voltage Vpam of FIGS. 5, 7, and 9 is configured to make the driving transistor Mdr provide a driving current which drives the light emitting element LU in the highest light emitting efficiency. Thereof, the driving voltage Vpam may have different value when being provided to pixel circuit having different light color.

Figure 11:
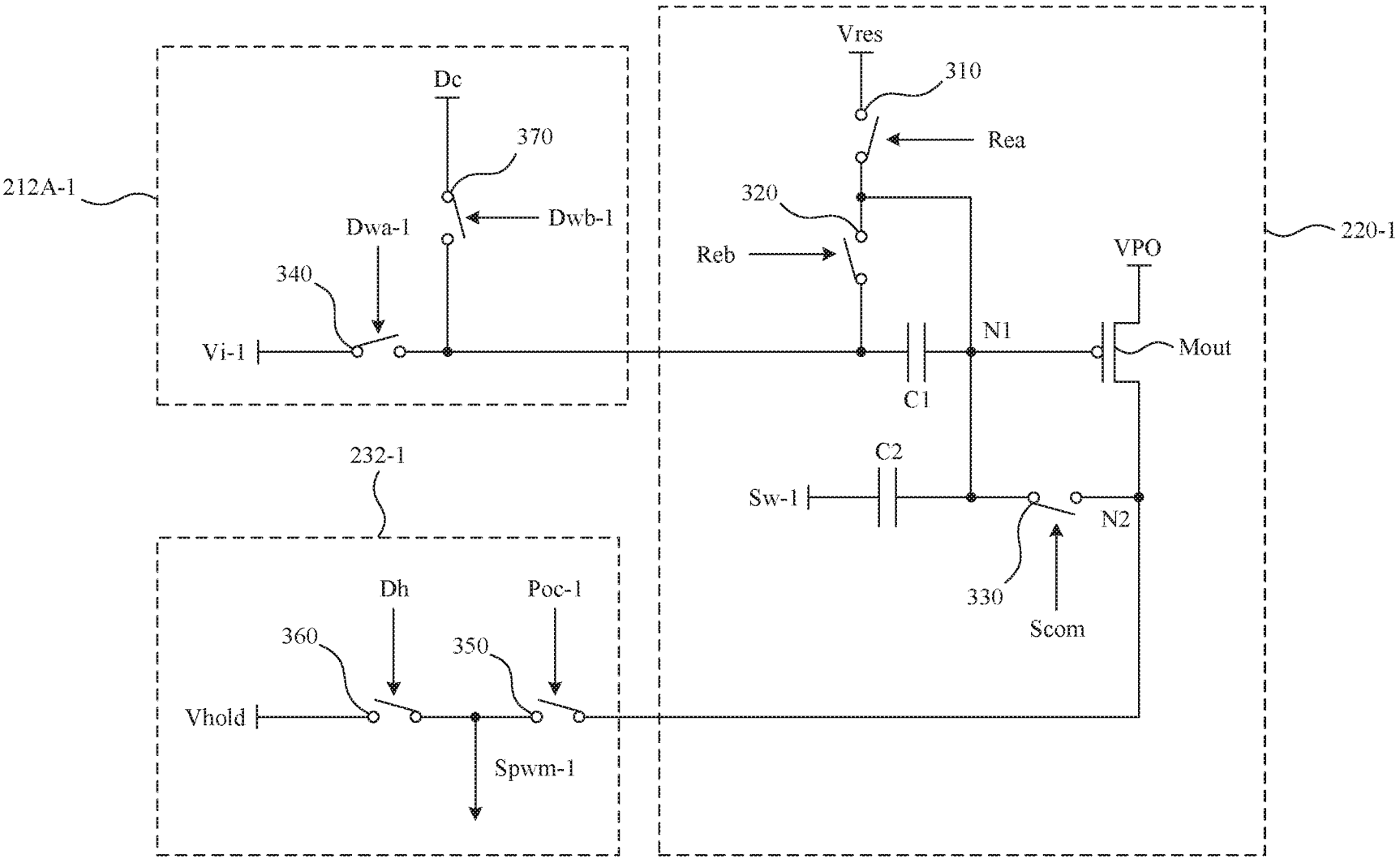
FIG. 11 is a schematic diagram for illustrating a first switching element, a driving circuit, and a second switching element according to one embodiment of the present disclosure.

FIG. 11 is a schematic diagram for illustrating a first switching element 212A-1, a driving circuit 220-1, and a second switching element 232-1 according to one embodiment of the present disclosure. The first switching element 212A-1 is similar to the first switching element 212-1 of FIG. 2, and the difference is that the first switching element 212A-1 further comprises a seventh switch 370. A first terminal of the seventh switch 370 is configured to receive the reference voltage Dc. A second terminal of the seventh switch 370 is coupled with the first terminal of the fourth switch 340. The control terminal of the seventh switch 370 is configured to receive the second writing signal Dwb-1.

In this embodiment, the seventh switch 370 may be conducted after the fourth switch 340 is switched off so that the voltage range of the first node N1 can be further expanded by capacitive coupling.

One or more of the first switching elements 212-1~212-6 of FIG. 2 may be replaced by the first switching element 212A-1 of FIG. 11. Notably, control terminals of different seventh switches 370 are configured to respectively receive different signals.

Figure 12:
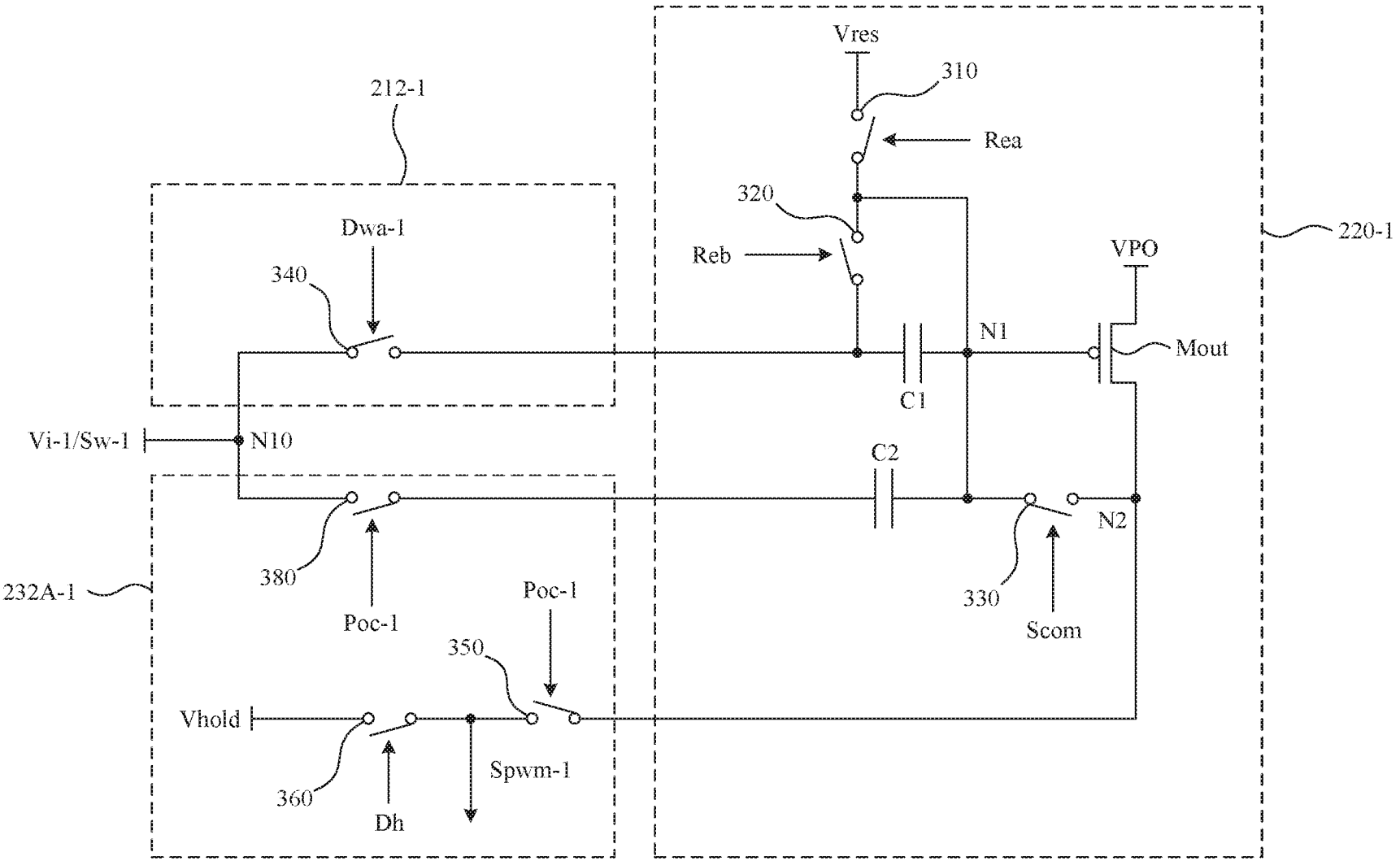
FIG. 12 is a schematic diagram for illustrating a first switching element, a driving circuit, and a second switching element according to one embodiment of the present disclosure.

FIG. 12 is a schematic diagram for illustrating a first switching element 212-1, a driving circuit 220-1, and a second switching element 232A-1 according to one embodiment of the present disclosure. The second switching element 232A-1 is similar to the second switching element 232-1 of FIG. 2, and the difference is that the second switching element 232A-1 further comprises an eighth switch 380. A first terminal of the eighth switch 380 is coupled with the second terminal of the second capacitor C2. A second terminal of the eighth switch 380 is coupled with the second terminal of the fourth switch 340 through the tenth node N10, and configured to receive the scanning signal Sw-1. A control terminal of the eighth switch 380 is configured to receive the first output control signal Poc-1.

In this embodiment, when the ninth node N9 provides the input voltage Vi-1, the fourth switch 340 is conducted and the eighth switch 380 is switched off. When the ninth node N9 provides the scanning signal Sw-1, the fourth switch 340 is switched off and the eighth switch 380 is conducted.

One or more of the second switching elements 232-1~232-6 of FIG. 2 may be replaced by the second switching element 232A-1 of FIG. 12. Notably, the control terminals of different eighth switches 380 are configured to respectively receive different signals. For example, if the second switching element 232-1 is replaced by the second switching element 232A-1, the control terminal of the eighth switch 380 thereof is configured to receive the first output control signal Poc-1. As another example, if the second switching element 232-2 is replaced by the second switching element 232A-1, the control terminal of the eighth switch 380 thereof is configured to receive the first output control signal Poc-2, and so on.

As can be appreciated from the forgoing descriptions, the display device 100 is capable of providing the driving current, having a fixed magnitude and a variable pulse width, to the light emitting element LU so as to reduce the color shift phenomenon of micro LED.

In addition, the pulse width of the driving current is controlled by the driving chip 110 rather than by the pixel circuit, and thus the display device 100 is suitable for simple pixel circuits (e.g., the pixel circuit 500, the pixel circuit 700, and the pixel circuit 900) to increase pixels per inch (PPI).

Certain terms are used throughout the description and the claims to refer to particular components. One skilled in the art appreciates that a component may be referred to as different names. This disclosure does not intend to distinguish between components that differ in name but not in function. In the description and in the claims, the term "comprise" is used in an open-ended fashion, and thus should be interpreted to mean "include, but not limited to." The term "couple" is intended to compass any indirect or direct connection. Accordingly, if this disclosure mentioned that a first device is coupled with a second device, it means that the first device may be directly or indirectly connected to the second device through electrical connections, wireless communications, optical communications, or other signal connections with/without other intermediate devices or connection means.

In addition, the singular forms "a," "an," and "the" herein are intended to comprise the plural forms as well, unless the context clearly indicates otherwise.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A driving chip, comprising:

a plurality of digital-to-analog converters (DACs), configured to provide a plurality of input voltages according to a data input; and a plurality of control circuits, configured to provide a plurality of emission control signals, wherein each of the plurality of control circuits is configured to provide, according to a corresponding input voltage of the plurality of input voltages, a corresponding emission control signal of the plurality of emission control signals, wherein when the plurality of control circuits are coupled with a pixel array, M pixel circuits of the pixel array are configured to emit light respectively in M periods, and M is a positive integer, wherein in a corresponding period of the M periods, one of the plurality of control circuits determines a first time length which the corresponding emission control signal has a first voltage level, and a corresponding pixel circuit of the M pixel circuits emits light, in the corresponding period, for an light emission time length corresponding to the first time length.

2. The driving chip of claim 1, wherein each of the plurality of control circuits comprises:

a plurality of driving circuits, configured to receive a plurality of scanning signals, and configured to sequentially provide a cut-off signal having the first voltage level;

a first multiplexer, coupled with a corresponding DAC of the plurality of DACs to receive the corresponding input voltage, and configured to provide the corresponding input voltage sequentially to the plurality of driving circuits; and a second multiplexer, coupled with the plurality of driving circuits, configured to output the cut-off signal, provided by the plurality of driving circuits sequentially, as the corresponding emission control signal, wherein each of the plurality of driving circuits determines, according to the corresponding input voltage and a voltage variation of a corresponding scanning signal of the plurality of scanning signals, a time duration for providing the cut-off signal so as to determine the first time length.

3. The driving chip of claim 2, wherein in a first operation stage, the second multiplexer provides a hold voltage as the corresponding emission control signal so that the corresponding emission control signal has a second voltage level, wherein in a second operation stage, the second multiplexer outputs the cut-off signal, provided by the plurality of driving circuits sequentially, as the corresponding emission control signal, the first operation stage is different from the second operation stage, and the first voltage level is different from the second voltage level.

4. The driving chip of claim 2, wherein the corresponding scanning signal is configured to provide a ramp pulse.

5. The driving chip of claim 2, wherein each of the plurality of driving circuits comprises:

an output transistor, comprising a first terminal, a second terminal, and a control terminal, wherein the first terminal of the output transistor is configured to receive the cut-off signal, and the second terminal of the output transistor is coupled with the second multiplexer;

a first node, coupled with the control terminal of the output transistor, configured to receive, by capacitive coupling, the corresponding input voltage from the first multiplexer, and further configured to receive, by capacitive coupling, the corresponding scanning signal;

a second node, coupled with the second terminal of the output transistor, and configured to provide the cut-off signal to the second multiplexer;

a first capacitor, comprising a first terminal and a second terminal, wherein the first terminal of the first capacitor is coupled with the first node, and the second terminal of the first capacitor is coupled with the first multiplexer; and a second capacitor, comprising a first terminal and a second terminal, wherein the first terminal of the second capacitor is coupled with the second terminal of the first capacitor, and the second terminal of the second capacitor is configured to receive the corresponding scanning signal or is coupled with the second multiplexer.

6. The driving chip of claim 5, wherein each of the plurality of driving circuits further comprises:

a first switch, comprising a first terminal, a second terminal, and a control terminal, wherein the first terminal of the first switch is coupled with the first node, the second terminal of the first switch is configured to receive a reset voltage, and the control terminal of the first switch is configured to receive a first reset signal;

a second switch, comprising a first terminal, a second terminal, and a control terminal, wherein the first terminal of the second switch is coupled with the first node, the second terminal of the second switch is coupled with the second terminal of the first capacitor, and the control terminal of the second switch is configured to receive a second reset signal; and a third switch, comprising a first terminal, a second terminal, and a control terminal, wherein the first terminal of the third switch is coupled with the second node, the second terminal of the third switch is coupled with the first node, and the control terminal of the third switch is configured to receive a compensation signal.

7. The driving chip of claim 6, wherein the first multiplexer comprises a plurality of first switching elements, the plurality of first switching elements are coupled with the plurality of driving circuits, respectively, wherein if the second terminal of the second capacitor is configured to receive the corresponding scanning signal, each of the plurality of first switching elements comprises:

a fourth switch, comprising a first terminal, a second terminal, and a control terminal, wherein the first terminal of the fourth switch is coupled with the second terminal of the first capacitor, the second terminal of the fourth switch is configured to receive the corresponding input voltage, and the control terminal of the fourth switch is configured to receive a first writing signal.

8. The driving chip of claim 6, wherein the second multiplexer comprises a plurality of second switching elements, and the plurality of second switching elements are coupled with the plurality of driving circuits, respectively, wherein if the second terminal of the second capacitor is configured to receive the corresponding scanning signal, each of the plurality of second switching elements comprises:

a third node, configured to provide the corresponding emission control signal;

a fifth switch, comprising a first terminal, a second terminal, and a control terminal, wherein the first terminal of the fifth switch is coupled with the second node, the second terminal of the fifth switch is coupled with the third node, and the control terminal of the fifth switch is configured to receive a first output control signal; and a sixth switch, comprising a first terminal, a second terminal, and a control terminal, the first terminal of the sixth switch is coupled with the third node, the second terminal of the sixth switch is configured to receive a hold voltage, and the control terminal of the sixth switch is configured to receive a second output control signal.

9. The driving chip of claim 6, wherein the first multiplexer comprises a plurality of first switching elements, the plurality of first switching elements are coupled with the plurality of driving circuits, respectively, and each of the plurality of first switching elements comprises:

a fourth switch, comprising a first terminal, a second terminal, and a control terminal, wherein the first terminal of the fourth switch is coupled with the second terminal of the first capacitor, the second terminal of the fourth switch is configured to receive the corresponding input voltage, and the control terminal of the fourth switch is configured to receive a first writing signal; and a seventh switch, comprising a first terminal, a second terminal, and a control terminal, wherein the first terminal of the seventh switch is configured to receive a reference voltage, the second terminal of the seventh switch is coupled with the first terminal of the fourth switch, and the control terminal of the seventh switch is configured to receive a second writing signal.

10. The driving chip of claim 9, wherein the second multiplexer comprises a plurality of second switching elements, the plurality of second switching elements are coupled with the plurality of driving circuits, respectively, wherein if the second terminal of the second capacitor is coupled with the second multiplexer, each of the plurality of second switching elements comprises:

a third node, configured to provide the corresponding emission control signal;

a fifth switch, comprising a first terminal, a second terminal, and a control terminal, wherein the first terminal of the fifth switch is coupled with the second node, the second terminal of the fifth switch is coupled with the third node, and the control terminal of the fifth switch is configured to receive a first output control signal;

a sixth switch, comprising a first terminal, a second terminal, and a control terminal, the first terminal of the sixth switch is coupled with the third node, the second terminal of the sixth switch is configured to receive a hold voltage, and the control terminal of the sixth switch is configured to receive a second output control signal; and an eighth switch, comprising a first terminal, a second terminal, and a control terminal, wherein the first terminal of the eighth switch is coupled with the second terminal of the second capacitor, the second terminal of the eighth switch is configured to receive the corresponding scanning signal, and the control terminal of the eighth switch is configured to receive the first output control signal.

11. A display device, comprising:

a driving chip, configured to provide a plurality of emission control signals according to a data input; and a pixel array, coupled with the driving chip, wherein M pixel circuits of the pixel array are configured to emit light respectively in M periods, and M is a positive integer, wherein in a corresponding period of the M periods, the driving chip determines a first time length which one of the plurality of emission control signals has a first voltage level, and one of the M pixel circuits emits light, in the corresponding period, for a light emission time length corresponding to the first time length.

12. The display device of claim 11, wherein the driving chip comprises:

a plurality of DACs, configured to convert the data input to a plurality of input voltages; and a plurality of control circuits, configured to provide the plurality of emission control signals, wherein each of the plurality of control circuits provides, according to a corresponding input voltage of the plurality of input voltages, a corresponding emission control signal of the plurality of emission control signals, and determines the first time length of the corresponding emission control signal.

13. The display device of claim 12, wherein each of the plurality of control circuits comprises:

a plurality of driving circuits, configured to receive a plurality of scanning signals, and configured to sequentially provide a cut-off signal having the first voltage level;

a first multiplexer, coupled with a corresponding DAC of the plurality of DACs to receive the corresponding input voltage, and configured to provide the corresponding input voltage sequentially to the plurality of driving circuits; and a second multiplexer, coupled with the plurality of driving circuits, and configured to output the cut-off signal, provided by the plurality of driving circuits sequentially, as the corresponding emission control signal, wherein each of the plurality of driving circuits determines, according to the corresponding input voltage and a voltage variation of a corresponding scanning signal of the plurality of scanning signals, a time duration for providing the cut-off signal so as to determine the first time length.

14. The display device of claim 13, wherein in a first operation stage, the second multiplexer provides a hold voltage as the corresponding emission control signal so that the corresponding emission control signal has a second voltage level, wherein in a second operation stage, the second multiplexer outputs the cut-off signal, provided by the plurality of driving circuits sequentially, as the corresponding emission control signal, the first operation stage is different from the second operation stage, and the first voltage level is different from the second voltage level.

15. The display device of claim 13, wherein the corresponding scanning signal is configured to provide a ramp pulse.

16. The display device of claim 13, wherein each of the plurality of driving circuits comprises:

an output transistor, comprising a first terminal, a second terminal, and a control terminal, wherein the first terminal of the output transistor is configured to receive the cut-off signal, the second terminal of the output transistor is coupled with the second multiplexer;

a first node, coupled with the control terminal of the output transistor, configured to receive, by capacitive coupling, the corresponding input voltage from the first multiplexer, and configured to receive, by capacitive coupling, the corresponding scanning signal;

a second node, coupling with the second terminal of the output transistor, and configured to provide the cut-off signal to the second multiplexer;

a first capacitor, comprising a first terminal and a second terminal, wherein the first terminal of the first capacitor is coupled with the first node, and the second terminal of the first capacitor is coupled with the first multiplexer; and a second capacitor, comprising a first terminal and a second terminal, wherein the first terminal of the second capacitor is coupled with the second terminal of the first capacitor, and the second terminal of the second capacitor is configured to receive the corresponding scanning signal or is coupled with the second multiplexer.

17. The display device of claim 16, wherein each of the plurality of driving circuits further comprises:

a first switch, comprising a first terminal, a second terminal, and a control terminal, wherein the first terminal of the first switch is coupled with the first node, the second terminal of the first switch is configured to receive a reset voltage, and the control terminal of the first switch is configures to receive a first reset signal;

a second switch, comprising a first terminal, a second terminal, and a control terminal, wherein the first terminal of the second switch is coupled with the first node, the second terminal of the second switch is coupled with the second terminal of the first capacitor, and the control terminal of the second switch is configured to receive a second reset signal; and a third switch, comprising a first terminal, a second terminal, and a control terminal, wherein the first terminal of the third switch is coupled with the second node, the second terminal of the third switch is coupled with the first node, and the control terminal of the third switch is configured to receive a compensation signal.

18. The display device of claim 17, wherein the first multiplexer comprises a plurality of first switching elements, the plurality of first switching elements are coupled with the plurality of driving circuits, respectively, wherein if the second terminal of the second capacitor is configured to receive the corresponding scanning signal, each of the plurality of first switching elements comprises:

a fourth switch, comprising a first terminal, a second terminal, and a control terminal, wherein the first terminal of the fourth switch is coupled with the second terminal of the first capacitor, the second terminal of the fourth switch is configured to receive the corresponding input voltage, and the control terminal of the fourth switch is configured to receive a first writing signal.

19. The display device of claim 17, wherein the second multiplexer comprises a plurality of second switching elements, the plurality of second switching elements are coupled with the plurality of driving circuits, respectively, wherein if the second terminal of the second capacitor is configured to receive the corresponding scanning signal, each of the plurality of second switching elements comprises:

a third node, configured to provide the corresponding emission control signal;

a fifth switch, comprising a first terminal, a second terminal, and a control terminal, wherein the first terminal of the fifth switch is coupled with the second node, the second terminal of the fifth switch is coupled with the third node, and the control terminal of the fifth switch is configured to receive a first output control signal; and a sixth switch, comprising a first terminal, a second terminal, and a control terminal, the first terminal of the sixth switch is coupled with the third node, the second terminal of the sixth switch is configured to receive a hold voltage, and the control terminal of the sixth switch is configured to receive a second output control signal.

20. The display device of claim 17, wherein the first multiplexer comprises a plurality of first switching elements, the plurality of first switching elements are coupled with the plurality of driving circuits, respectively, and each of the plurality of first switching elements comprises:

a fourth switch, comprising a first terminal, a second terminal, and a control terminal, wherein the first terminal of the fourth switch is coupled with the second terminal of the first capacitor, the second terminal of the fourth switch is configured to receive the corresponding input voltage, and the control terminal of the fourth switch is configured to receive a first writing signal; and a seventh switch, comprising a first terminal, a second terminal, and a control terminal, wherein the first terminal of the seventh switch is configured to receive a reference voltage, the second terminal of the seventh switch is coupled with the first terminal of the fourth switch, and the control terminal of the seventh switch is configured to receive a second writing signal.

21. The display device of claim 20, wherein the second multiplexer comprises a plurality of second switching elements, the plurality of second switching elements are coupled with the plurality of driving circuits, respectively, wherein if the second terminal of the second capacitor is coupled with the second multiplexer, each of the plurality of second switching elements comprises:

a third node, configured to provide the corresponding emission control signal;

a fifth switch, comprising a first terminal, a second terminal, and a control terminal, wherein the first terminal of the fifth switch is coupled with the second node, the second terminal of the fifth switch is coupled with the third node, and the control terminal of the fifth switch is configured to receive a first output control signal;

a sixth switch, comprising a first terminal, a second terminal, and a control terminal, wherein the first terminal of the sixth switch is coupled with the third node, the second terminal of the sixth switch is configured to receive a hold voltage, and the control terminal of the sixth switch is configured to receive a second output control signal; and an eighth switch, comprising a first terminal, a second terminal, and a control terminal, wherein the first terminal of the eighth switch is coupled with the second terminal of the second capacitor, the second terminal of the eighth switch is configured to receive the corresponding scanning signal, and the control terminal of the eighth switch is configured to receive the first output control signal.

* * * * *